United States Patent [19]

Milam

[11] 4,083,408

[45] Apr. 11, 1978

[54] WELL COMPLETION APPARATUS

[75] Inventor: Jack J. Milam, Oklahoma City, Okla.

[73] Assignee: Brown Oil Tools, Inc., Houston, Tex.

[21] Appl. No.: 754,432

[22] Filed: Dec. 27, 1976

[51] Int. Cl.[2] ..... E21B 23/00; E21B 43/10

[52] U.S. Cl. ..... 166/315; 166/115; 166/208

[58] Field of Search ..... 166/315, 115, 116, 208, 166/89, 236

[56] References Cited

U.S. PATENT DOCUMENTS

| | | | |
|---|---|---|---|
| 2,631,670 | 3/1953 | Armentrout | 166/116 |
| 2,911,048 | 11/1959 | Dublin et al. | 166/116 |
| 3,282,341 | 11/1966 | Hodges | 166/115 |
| 3,527,302 | 9/1970 | Broussard | 166/116 |

FOREIGN PATENT DOCUMENTS

| | | | |
|---|---|---|---|
| 681,647 | 1/1965 | Italy | 166/89 |

*Primary Examiner*—James A. Leppink
*Attorney, Agent, or Firm*—Browning, Bushman & Zamecki

[57] ABSTRACT

Well completion apparatus for disposition in a well conduit comprising first and second seal assemblies. The first seal assembly comprises a first cylindrical receptacle member fixed with respect to the well conduit and a first insert member including a first tubular body portion received within the first receptacle member. One of the first members includes a first annular seal coaxial with and sealingly engaged between the first receptacle member and the first tubular body portion. The second seal assembly comprises a second cylindrical receptacle member rigidly adjoining the first tubular body portion and a second insert member including a second tubular body portion received within the second receptacle member. One of the second members includes a second annular seal means coaxial with and sealingly engaged between the second receptacle member and the second tubular body portion. The second insert member is longitudinally slidable within the second receptacle member and its outer diameter adjacent the second seal is less than the outer diameter of the first insert member adjacent the first seal.

17 Claims, 5 Drawing Figures

WELL COMPLETION APPARATUS

BACKGROUND OF THE INVENTION

1. Field of the Invention

The present invention pertains to well completion apparatus and methods used in connection with oil wells, gas wells, and the like. Well completion operations are typically performed after the drilling of a well is complete to prepare the well for production. The well is usually cased and a liner may be installed within the casing near the lower end thereof. The production tubing is typically installed within and/or extending upwardly from the liner. It is then necessary to provide for sealing between the outer surface of the tubing and the inner surface of the casing.

2. Description of the Prior Art

One method of providing such a seal is to install a suitable sleeve in the casing above the upper end of the liner and seal between the sleeve and the casing with a permanent packer. The tubing is then allowed to extend into the sleeve and another seal is provided between the tubing and the sleeve. The main problem with this arrangement is the relative permanence of the installation which makes workover operations and the like difficult and expensive.

Another approach is to allow the tubing to extend into the liner or an extension thereof and provide a seal therebetween. Then, if the liner is sealed with respect to the casing by cement and/or a packer, the tubing is effectively sealed with respect to the casing. This arrangement is generally acceptable if a relatively large diameter tubing is employed, i.e. one whose diameter is comparable to the diameter of the liner. However, problems may arise when relatively small diameter tubing is employed and pressure builds up in the area below the seal. This is because a large annular cross-sectional area defined by the inner diameters of the tubing and liner is available to act as a piston in resisting the pressure and tending to urge the tubing string upwardly. This in turn can cause deformation and damage to the tubing.

SUMMARY OF THE INVENTION

In accord with the present invention, a liner extension may be employed as the receptacle member of a first seal assembly. However, rather than directly receiving and being sealed to the tubing, this first receptacle member receives a first tubular body portion of a first insert member. One of the two first members includes first annular seal means coaxial with and sealingly engaged between the first receptacle member and the first tubular body portion.

A second seal assembly is then formed by a second receptacle member rigidly adjoined to the first tubular body portion and a second insert member having a second tubular body portion received in the second receptacle member. A portion or extension of the tubing may form the second tubular body portion. One of the second members includes second annular seal means coaxial with and sealingly engaged between the second receptacle member and the second tubular body portion. The second insert member is longitudinally slidable within the second receptacle member and has an outer diameter adjacent the second seal means which is less than the outer diameter of the first insert member adjacent the first seal means.

It can thus be seen that if pressure builds up beneath the second seal means, the second insert member will be free to slide upwardly in the second receptacle member. Thus the area effectively acting as a piston is merely a small annulus defined by the inner and outer diameters of the second insert member even though the tubing is effectively sealed to the casing. Thus the potential damaging force on the tubing for any given pressure value is reduced.

Furthermore, where the second receptacle member is substantially longer than the second seal means, a great deal of longitudinal movement of the tubing is permitted without losing the seal. This allows for relief of pressure, movement due to thermal expansion, etc. thereby further precluding the possibility of damage to the tubing.

In the preferred embodiments of the invention, the receptacle members are polished bore receptacles (commonly referred to as PBR's) and the seal means are carried by the tubular body portions of their respective seal assemblies. These seals may be of relatively small transverse cross-sectional area to enhance the reduction of effective piston area.

It can also be seen that one or both of the insert members may be easily and inexpensively removed for workover operations or the like and later re-inserted in the well. Furthermore, one or both of the insert members may be removed and replaced as needed to adapt the well for different sizes of tubing, while the fixed first receptacle member remains in place and is used with any of the different insert members, etc. If a large diameter tubing is to be used, it can be provided with a seal and inserted directly into the first receptacle member thereby eliminating the two seal assemblies. It can thus be seen that the invention is highly flexible and, in many cases, can even be adapted to existing wells having liner extensions or the like suitable for serving as the first receptacle member.

The invention also comprises a method of completing a well by securing the first receptacle member in the well, inserting the first insert member and adjoined second receptacle member (preferably anchoring them in the well), and finally inserting the second insert member for sliding movement in the second receptacle member.

Accordingly it is a principal object of the present invention to provide an improved dual seal well completion apparatus and method.

Another object of the present invention, is to provide a well completion apparatus which reduces the effective piston area available for urging a tubing string upwardly under the influence of pressure within the well.

Still another object of the present invention is to provide a sliding seal arrangement which permits relatively large longitudinal movements of a tubing string with respect to a fixed liner to which it is sealed.

Yet a further object of the present invention is to provide a seal arrangement which permits nondestructive removal of various parts and adaptation of the well for various operations.

Still further objects, features, and advantages of the present invention will be made apparent by the following description of the preferred embodiments, the drawings, and the claims.

DESCRIPTION OF THE PREFERRED EMBODIMENTS

Figure 1A:
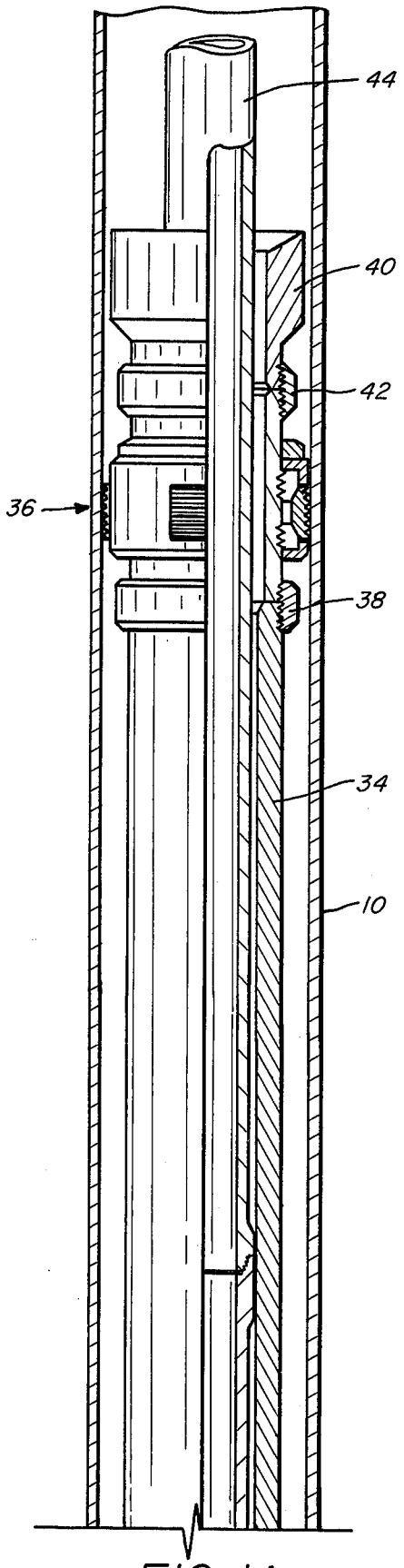
FIG. 1A is a longitudinal quarter-sectional view of the upper portion of the completion apparatus of the present invention.
Figure 1B:
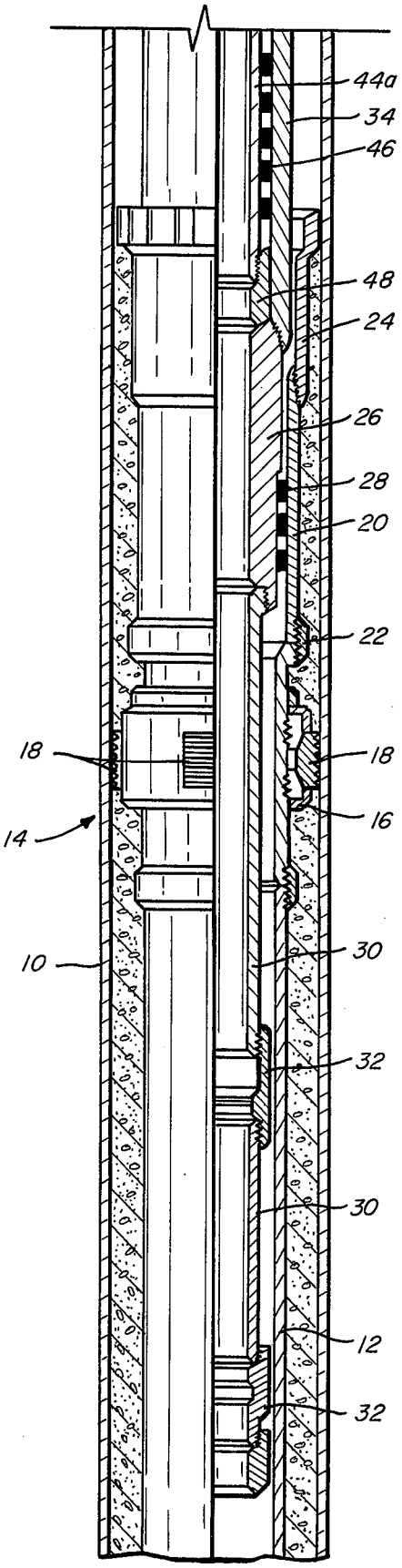
FIG. 1B is a continuation of FIG. 1A showing the lower portion of the well completion apparatus.

Referring now to FIGS. 1A and 1B, there is shown a well having a well conduit in the form of a casing 10. It should be understood that the invention may also be applied to situations in which the well conduit is defined by the uncased walls of the borehole itself or by some other conduit. A liner 12 is cemented in place within the casing 10. To temporarily suspend the liner within the casing prior to and during the cementing operation, a hanger or anchor assembly 14 is provided near the upper end of the liner. The anchor assembly 14 may be of any well-known type and need not be described in detail here. Briefly, it comprises a slip cage 16 and a plurality of slips 18 mounted therein. The slips have teeth on their outer surfaces and may be expanded radially with respect to the slip cage 16 to frictionally engage the inner surface of casing 10. Expansion of the slips 18 is typically accomplished by manipulation of the pipe string on which the liner is run into the well, although it can be accomplished in other ways depending on the type of anchor assembly employed.

A first cylindrical receptacle member 20 is connected to the upper end of the liner 12 by a collar 22, similar to those used to connect the various sections of the liner, and thus forms an extension of the liner. A guide sleeve 24, the function of which is described more fully below, is threadedly connected to the upper end of first receptacle member 20. Member 20 and sleeve 24 are cemented to the casing along with liner 12 as shown.

The inner surface of first receptacle member 20 is highly polished, preferably being lined with polytetrafluoroethylene (known commercially as "Teflon") or the like, so as to form a polished bore receptacle or PBR. A first insert member, comprising a first tubular body portion 26 and first annular seal means 28 encircling and secured to body portion 26, is received in receptacle member 20. Seal means 28 may be of any type which is capable of maintaining a sliding seal against the polished bore of receptacle member 20. Preferably, the seal means 28 comprises a stack of chevron rings or other seal means which has a relatively small transverse cross-sectional area and which does not depend on gross compression or deformation or the presence of pressure differentials in order to maintain its seal.

A series of sleeves 30 and nipples 32 may extend downwardly into the liner 12 from body portion 26 so that plugs and other tools may be landed in the nipples during subsequent operations in the well. Threadedly connected to the upper end of body portion 26 is a second receptacle member 34. Second receptacle member 34 is run into the well along with the attached first insert member 26, 28 and is anchored to the casing 10 by an anchor assembly 36 substantially identical to assembly 14. Assembly 36 is attached to the upper end of receptacle member 34 by a collar 38, and a guide sleeve 40 is attached to the upper end of anchor assembly 36 by a similar collar 42.

The inner surface of member 34 is finished in the same manner as the inner surface of member 20 so that member 34 serves as a second polished bore receptacle or PBR. The lower end **44*a* of a string of production tubing 44 is inserted into the polished bore of receptacle member 34 to serve as the tubular body portion of a second insert member, the second insert member also comprising second annular seal means 46 encircling and secured to body portion 44*a*. Seal means 46 is similar to seal means 28 and forms a sliding seal against the polished bore of receptacle member 34**.

The inner diameter of receptacle member 34 is greater than that of tubular body portion 26, and the radial extent or transverse cross-sectional area of seal means 46 is small. Thus a bushing ring 48 threadedly connected to the lower end of body portion **44*a* is permitted to abut the upper end of body portion 26 to limit downward movement of the tubing 44. However, since the tubing 44 is not anchored to the casing, and the second receptacle member 34 is relatively long, great freedom for upward movement of the tubing string under pressure is permitted without losing the seal. The longitudinal extent of receptacle member 34 is preferably at least 3 or 4 times longer than that of the seal means 46 and, in a typical installation, may be on the order of 40 feet long. The difference in inner diameters of the members 26 and 34, coupled with the relatively small transverse cross-sectional extent of seal means 46 also permits the inner diameters of the tubing 44 and the member 26 to be approximately equal so that there is a "clear shot" into the sleeves 30 and nipples 32** for any tools which may need to be inserted.

If pressure should build up in the bottom of the well due to conditions within the formation, application of a test pressure, or any other cause, the production tubing 44 including the portion **44*a* and seal means 46 is free to move upwardly with respect to receptacle member 34. Thus the transverse cross-sectional area of the apparatus available to act as a piston in response to such pressure is an annular area defined by the inner diameter of the body portion 44*a* and the outer diameter of seal means 46. If the same size tubing were sealed directly to the liner 12 or an extension thereof such as receptacle 20, the piston area would be much larger and the force on the tubing would be increased. However, by the use of two successive polished bore receptacle type seal assemblies, with the outer diameter of seal 46 being less than the outer diameter of seal 28**, the force is decreased while the tubing is still sealed with respect to the liner.

For example, in a well having a $7\frac{5}{8}$ inch diameter casing and a $4\frac{1}{2}$ inch liner, a $2\frac{7}{8}$ inch tubing is sealed with respect to a 5 inch seal receptacle on the liner, with a single seal carried by an adapter on the tubing, at 15,000 feet. Application of a test pressure of 10,000 ppsi to the well will result in an upward piston force of 149,500 pounds on the tubing. The "piston" formed by the lower end of the tubing will move 41.3 feet and such movement will result in an unacceptable degree of buckling in the tubing string. However, if an insert member is installed in the 5 inch seal receptacle of the liner and sealed thereto, and if the insert member forms a 3.25 inch seal receptacle for receipt of the tubing and its respective seal means, the application of the same test pressure at the same depth will result in an upward piston force of only 36,100 pounds. The upward movement will be reduced to 10 feet and the buckling will be held below an acceptable limit which will not result in permanent damage to the tubing. Furthermore, sufficient length of the second polished bore receptacle can compensate for such upward movement as does occur.

Figure 2:
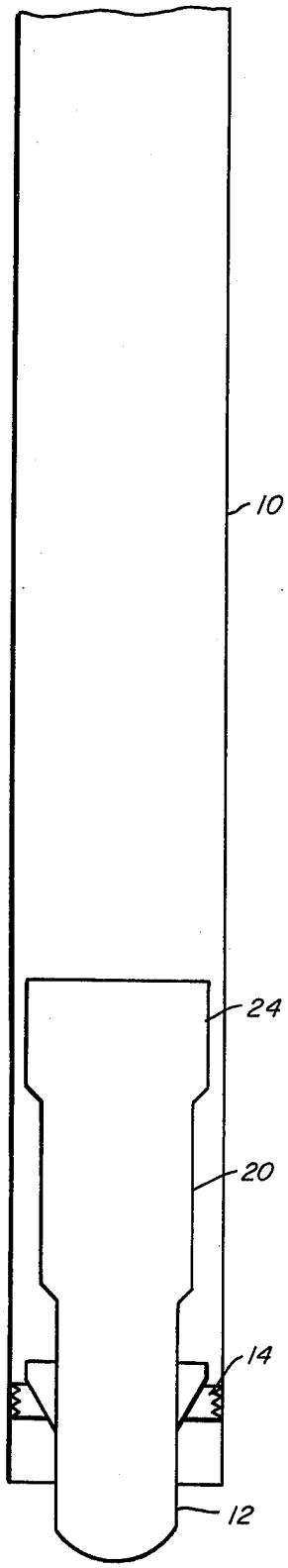
FIGS. 2, 3, and 4 are schematic views showing successive stages in the completion of a well according to the present invention.
Figure 3:
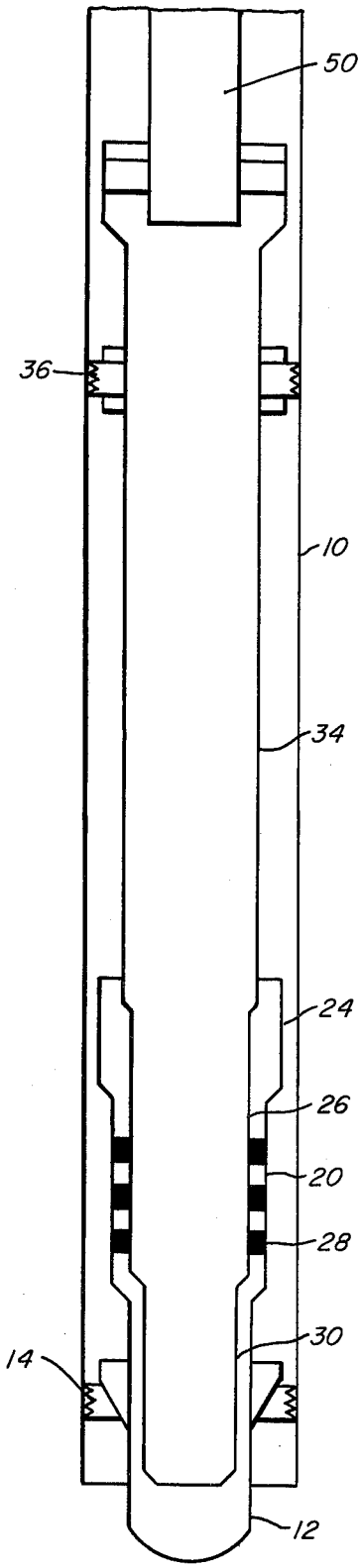
Figure 4:
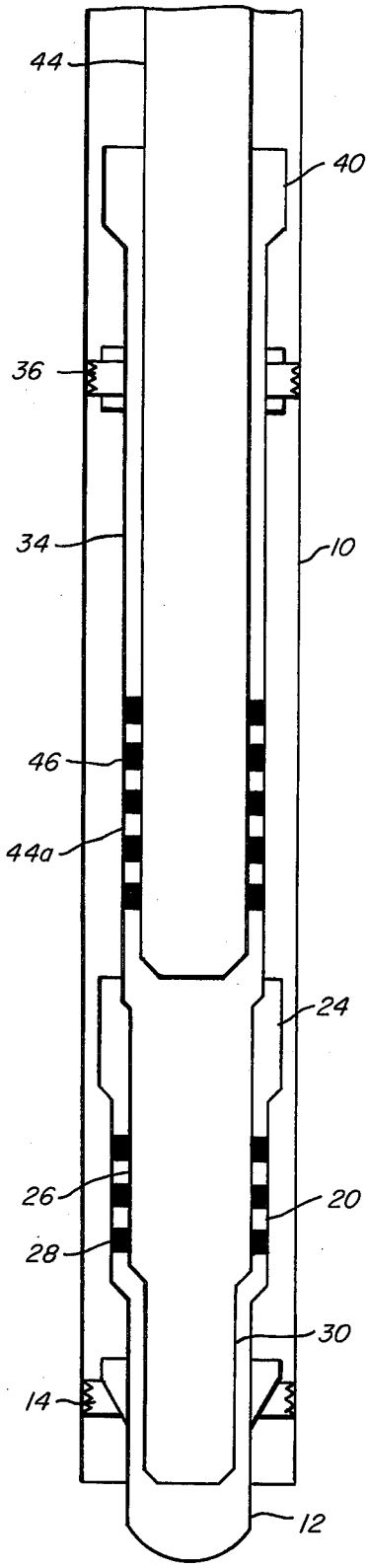

Referring now to FIGS. 2, 3 and 4, successive stages in the installation of the apparatus of FIGS. 1A and 1B are shown in schematic. In FIG. 2, the liner 12 with the attached receptacle member 20 and guide sleeve 34 have been run into the well on a suitable tool, anchored to the casing 10 by means of assembly 14, and cemented in place. In FIG. 3, the first insert member 26, 28 with the attached sleeves 30 and second receptacle member 34 have been run into the well by a tool 50. During insertion, the enlarged inner diameter of guide sleeve 24 cooperates with the successively larger diameters of sleeves 30 and insert member 26, 28 to guide the latter into place in the first receptacle member 20 as shown. The upper end of the second receptacle member 34 can then be anchored to casing 10 by assembly 36, operated by manipulation of tool 50 or in any other suitable manner, and tool 50 can then be disengaged and removed. The second insert member **44*a*, 46 is finally run into the well with the tubing 44 of which it forms a part. The bevelled upper surface of sleeve 40 (see FIG. 1A) serves to guide the tubular body portion 44*a* into place in the receptacle 34 as shown in FIG. 4**.

Test pressures can now be applied to the well with the above-described result. It can be seen that insert member **44*a*, 46 as well as insert member 26, 28 with the attached receptacle member 34 can be easily removed for various purposes without drilling through or otherwise destroying the seal means 28 and 46. For example, they may be removed for workover operations and then re-inserted in the well. They may also be removed and replaced with similar parts of different diameters to adapt the well to a different size tubing. If it is desired to use a relatively large tubing whose diameter is on the order of that of the liner 12, such tubing, with its lower end encircled by seal means, may be inserted directly into receptacle member 20**.

It can thus be seen that the apparatus and method of the present invention are highly adaptable and economical and that they substantially reduce the danger of damage when relatively small size tubing is used. It can also be seen that numerous modifications of the preferred embodiments may be made without departing from the spirit of the invention. For example, parts which have been illustrated as threadedly or otherwise rigidly connected could, in some instances be formed as one integral part. In either event, such parts may be referred to as "rigidly adjoining." In both of the seal assemblies of the above-described embodiment, the insert member comprises the tubular body portion together with the seal means. However, in some instances the insert member of one or both of the seal assemblies may simply comprise the tubular body portion, with the seal means being fixed within and forming a part of the receptacle member. However, in any case, the primary advantages of the invention will be realized if the outer diameter of the second insert member adjacent the second seal means is less than that of the first insert member adjacent the first seal means. It is thus intended that the scope of the invention be limited only by the claims which follow.

I claim:

1. Well completion apparatus for disposition in a well conduit to seal between a well liner and a well string extending into said well liner, said well completion apparatus comprising:

a. a first seal assembly comprising:
   1. a first tubular receptacle member rigidly adjoining said well liner and fixed with respect to said well conduit; and
   2. a first insert member including a first tubular body portion received within said first receptacle member;
   3. one of said first members defining a first cylindrical sealing surface and the other of said first members including first annular seal means coaxial with and slidably sealingly engaged with said first sealing surface between said first receptacle member and said first tubular body portion; and b. a second seal assembly comprising:
   1. a second tubular receptacle member rigidly adjoining said first tubular body portion; and
   2. a second insert member included in said well string and including a second tubular body portion received within said second receptacle member;
   3. one of said second members defining a second cylindrical sealing surface, and the other of said second members including second annular seal means coaxial with and slidably sealingly engaged with said second sealing surface between said second receptacle member and said second tubular body portion; and
   4. said second insert member being longitudinally slidable within said second receptacle member and having an outer diameter adjacent said second seal means less than the outer diameter of said first insert member adjacent said first seal means.

2. The apparatus of claim 1 wherein said first seal means is carried by said first tubular body portion and is slidable within said first receptacle member, wherein said second seal means is carried by said second tubular portion and is slidable within said second receptacle member, and wherein the outer diameter of said second seal means is less than the outer diameter of said first seal means.

3. The apparatus of claim 2 further comprising a guide sleeve longitudinally adjacent said first receptacle member and at least partially of greater inner diameter than said first receptacle member for guiding said first insert member into said first receptacle member.

4. The apparatus of claim 2 wherein said first and second receptacles are polished bore receptacles.

5. The apparatus of claim 4 wherein said first and second receptacles are lined with friction reducing material defining said first and second sealing surfaces.

6. The apparatus of claim 4 wherein said first and second seal means are static seal means capable of sealing without gross deformation thereof.

7. The apparatus of claim 2 wherein the longitudinal extent of said second receptacle member is substantially greater than the longitudinal extent of said second seal means.

8. The apparatus of claim 7 further comprising first anchor means operative to fix said second receptacle member and said first insert member with respect to said well conduit.

9. The apparatus of claim 8 wherein said second receptacle member is disposed longitudinally adjacent said first insert member, wherein the inner diameter of said second receptacle member is greater than the inner diameter of said first tubular body portion, and wherein the inner diameter of said second tubular body portion is approximately equal to the inner diameter of said first tubular body portion.

10. The apparatus of claim 8 wherein said well string comprises a tubing string.

11. The apparatus of claim 8 wherein said first receptacle member comprises a rigid extension of said well liner.

12. The apparatus of claim 11 further comprising second anchor means operative to fix said first receptacle member and said well liner with respect to said well conduit.

13. The apparatus of claim 12 wherein said well liner is cemented to said well conduit.

14. A method of sealing between a well liner and a well string extending into said well liner comprising the steps of:

a. providing a first tubular receptacle member rigidly adjoining said well liner and securing said first receptacle member within a well conduit;

b. inserting a first insert member including a first tubular body portion into said first receptacle member whereby first annular seal means included on one of said first members slidably sealingly engages a first cylindrical sealing surface on the other of said first members between said first receptacle member and said first tubular body portion; and c. inserting a second insert member, included in said well string and including a second tubular body portion, into a second receptacle member rigidly adjoining said first insert member whereby second annular seal means included on one of said second members slidably sealingly engages a second cylindrical sealing surface on the other of said second members between said second receptacle member and said second tubular body portion to provide a sliding seal between said second members.

15. The method of claim 14 wherein step (a) includes anchoring said first receptacle member to said well conduit.

16. The method of claim 15 wherein step (a) further includes cementing said first receptacle member to said well conduit.

17. The method of claim 14 wherein step (c) is preceded by the step of anchoring said second receptacle member to said well conduit.

* * * * *